US009630214B2

(12) United States Patent
Hagemeier et al.

(10) Patent No.: US 9,630,214 B2
(45) Date of Patent: Apr. 25, 2017

(54) GRINDING MILL

(71) Applicant: THYSSENKRUPP RESOURCE TECHNOLOGIES GMBH, Beckum (DE)

(72) Inventors: Olaf Hagemeier, Beckum (DE); Aimo Dirk Haack, Ennigerloh (DE)

(73) Assignee: THYSSENKRUPP INDUSTRIAL SOLUTIONS AG, Essen (DE)

( * ) Notice: Subject to any disclaimer, the term of this patent is extended or adjusted under 35 U.S.C. 154(b) by 55 days.

(21) Appl. No.: 14/435,064

(22) PCT Filed: Oct. 9, 2013

(86) PCT No.: PCT/EP2013/071031
§ 371 (c)(1),
(2) Date: Apr. 10, 2015

(87) PCT Pub. No.: WO2014/056974
PCT Pub. Date: Apr. 17, 2014

(65) Prior Publication Data

US 2015/0258576 A1 Sep. 17, 2015

(30) Foreign Application Priority Data

Oct. 10, 2012 (DE) ..... 10 2012 109 644

(51) Int. Cl.
*B02C 23/12* (2006.01)
*B07B 9/02* (2006.01)
(Continued)

(52) U.S. Cl.
CPC ..... *B07B 9/02* (2013.01); *B02C 21/005* (2013.01); *B02C 23/12* (2013.01); *B07B 4/02* (2013.01); *B07B 7/01* (2013.01)

(58) Field of Classification Search
CPC ..... B02C 23/12; B02C 21/005; B07B 9/02; B07B 7/01; B07B 4/02
(Continued)

(56) References Cited

U.S. PATENT DOCUMENTS 1,002,504 A 9/1911 Edison
5,392,998 A * 2/1995 Suessegger ..... B02C 21/00 209/143
(Continued)

FOREIGN PATENT DOCUMENTS

CN 1418131 A 5/2003
CN 2808292 Y 8/2006
(Continued)

OTHER PUBLICATIONS

German Language International Search Report for International patent application No. PCT/EP2013/071031; mailing date Dec. 16, 2013.
(Continued)

*Primary Examiner* — Mark Rosenbaum
(74) *Attorney, Agent, or Firm* — thyssenkrupp North America, Inc.

(57) ABSTRACT

Disclosed is a grinding mill including a roller press configured to comminute grinding stock, a first conveying mechanism in communication with the roller press and configured to transport downstream at least one of fresh grinding stock or grinding stock comminuted by the roller press, and a static sifter disposed downstream of the first conveying mechanism and configured to sift at least one of the fresh grinding stock or grinding stock comminuted by said roller press. The static sifter includes a sifting stock inlet disposed in an upper sifting space, and sifting gas inlet disposed in a lower sifting space, and an aeration plate separating the upper sifting space from the lower sifting space. The aera-
(Continued)

tion plate also permits sifting gas to pass there through from the lower to the upper sifting space. The static sifter also includes oversized material outlets disposed in each of the respective upper and lower sifting spaces.

15 Claims, 3 Drawing Sheets

(51) Int. Cl.
*B07B 4/02* (2006.01)
*B02C 21/00* (2006.01)
*B07B 7/01* (2006.01)

(58) Field of Classification Search
USPC ..... 241/80, 97
See application file for complete search history.

(56) References Cited

U.S. PATENT DOCUMENTS

| | | | |
|---|---|---|---|
| 5,529,248 A | 6/1996 | Sawamura et al. | |
| 6,457,659 B1 | 10/2002 | Yang et al. | |
| 2005/0145732 A1 | 7/2005 | Oder et al. | |
| 2013/0082127 A1* | 4/2013 | Strasser | B02C 4/02 241/24.1 |

FOREIGN PATENT DOCUMENTS

| | | | |
|---|---|---|---|
| CN | 101947490 | A | 1/2011 |
| DE | 69421994 | T2 | 7/2000 |
| DE | 10221739 | A1 | 12/2003 |
| EP | 0084383 | A2 | 7/1983 |
| EP | 0374491 | A2 | 6/1990 |
| EP | 0650763 | A1 | 5/1995 |
| EP | 1079931 | A1 | 3/2001 |
| EP | 1786573 | B1 | 6/2010 |
| WO | 9937404 | A1 | 7/1999 |
| WO | 2007036276 | A1 | 4/2007 |
| WO | 03097241 | A1 | 11/2009 |

OTHER PUBLICATIONS

English translation of International Search Report for International patent application No. PCT/EP2013/071031; mailing date Dec. 16, 2013.
English Translation of Abstract for EP 0650763 (A1).
English Translation of Abstract for EP 0374491 (A2).
English Translation of Abstract for EP 0084383 (A2).
English Translation of Abstract for CN 2808292 (Y).
English Translation of Abstract for CN 101947490 (A).

* cited by examiner

GRINDING MILL

CROSS REFERENCE TO RELATED APPLICATIONS

This application is a U.S. National Stage Entry of International Patent Application Serial Number PCT/EP2013/071031, filed Oct. 9, 2013, which claims priority to German patent application no. DE 102012109644.9 filed Oct. 10, 2012, the entire contents of both of which are incorporated herein by reference.

FIELD

The present disclosure relates to a grinding installation for comminuting brittle grinding stock.

BACKGROUND

A recirculating grinding installation with a static sifter arranged above the roller press is known from EP 0 650 763 A1, wherein the oversized material from the sifter arrives in the feed shaft of the roller press by means of gravity. The fresh material, together with the slugs from the roller press output, is fed via a conveying mechanism to the static sifter. Furthermore, DE 10 221 739 A1 shows an arrangement in which the roller press is arranged above the static sifter. In this context, the width of the sifter is essentially matched to the width of the grinding rollers, such that the comminuted grinding stock reaches the static sifter with an optimum distribution across the width. However, both variants require a high expenditure in terms of construction and lead to a very great overall height. In particular, arranging the roller press above the static sifter is associated with enormous costs on account of the high weight.

In the interim, it has further been found that the efficiency of the static sifter can be increased if it is made wider and accordingly not as high. According to EP 1 786 573 B1, in that context, a ratio of width to vertical height of the aeration plate of at least 0.45 has been found to be particularly advantageous. However, roller presses are usually only 1.5 to maximum 2 m wide and a significant width increase cannot currently be envisaged. For that reason, very high and narrow static sifters are presently used. If one wished to position a wider and accordingly lower sifter beneath a roller press, it would be necessary to provide means for distributing the roller press output material over the breadth of the sifter. However, such measures require additional overall height.

Moreover, U.S. Pat. No. 1,002,504 A discloses a grinding installation which contains a roller press for comminuting brittle grinding stock with two counter-rotating grinding rollers, and also a static sifter with a sifting stock inlet for grinding stock comminuted in the roller press, with an outlet for oversized material and an outlet for fine material, wherein the outlet for oversized material is connected to the roller press. This grinding installation further contains a conveying mechanism which lifts the output of the roller press to the sifting stock inlet of the static sifter.

Finally, DE 694 21 994 T2 shows a grinding installation with a roller mill and a classifying device of the fluidized bed type. The box-shaped housing of this classifying device is divided, by a porous, inclined separating plate, into an upper fluidized bed chamber and a lower air inlet chamber. The grinding stock to be classified is introduced on one side from above into the fluidized bed chamber, while on the other side the fluidized fine material is removed upward and the oversized material which does not float is withdrawn downward.

SUMMARY

It is an object of the present disclosure to simplify, in terms of construction, a grinding installation and at the same time making a high sifting efficiency possible.

BRIEF DESCRIPTION OF THE DRAWINGS

The present disclosure is described in detail below with reference to the attached drawing figures, wherein.

DETAILED DESCRIPTION

With the roller press, the conveying mechanism and the sifter being arranged one next to the other in terms of construction, the overall height and thus the construction expenditure can be markedly reduced. Also, with the installation parts being arranged in a straight line one behind the other in terms of the material flow direction, the construction can be simplified since it is not necessary for material to be redirected laterally between the roller press and the sifter. The material to be sifted is thus transported in one direction and, in that context, raised up only by the conveying mechanism.

For the purpose of efficient sifting in the static sifter, it is important that the material be fed onto the sifter as evenly as possible. It is therefore of particular importance that, on the conveying mechanism, the width distribution of the material to be sifted is not disrupted by any redirections which deviate from the actual transport direction.

Within the scope of the invention, however, it is also possible for multiple roller presses and/or multiple conveying mechanisms and/or multiple static sifters to be used.

Since, according to the invention, the sifting stock inlet is arranged on that side of the sifter which is oriented toward the conveying mechanism, while the sifting gas inlet is connected on the sifter in a region which is oriented away from the conveying mechanism, it is possible for the installation parts which are arranged in a line one after the other, in particular the conveying mechanism and the sifter, to be arranged in a very compact manner According to the invention, the static sifter has two has two sifting spaces which are arranged one above the other and are separated from one another by the aeration plate, wherein the sifting stock inlet for the fresh grinding stock and/or the grinding stock comminuted in the roller press opens into the upper sifting space and the sifting gas inlet is connected to the lower sifting space. Furthermore, according to the invention, the first outlet for oversized material is connected to the upper sifting space and the lower sifting space is provided with a second outlet for oversized material.

The present disclosure is explained in further detail below with reference to the attached drawing figures.

Figure 1:
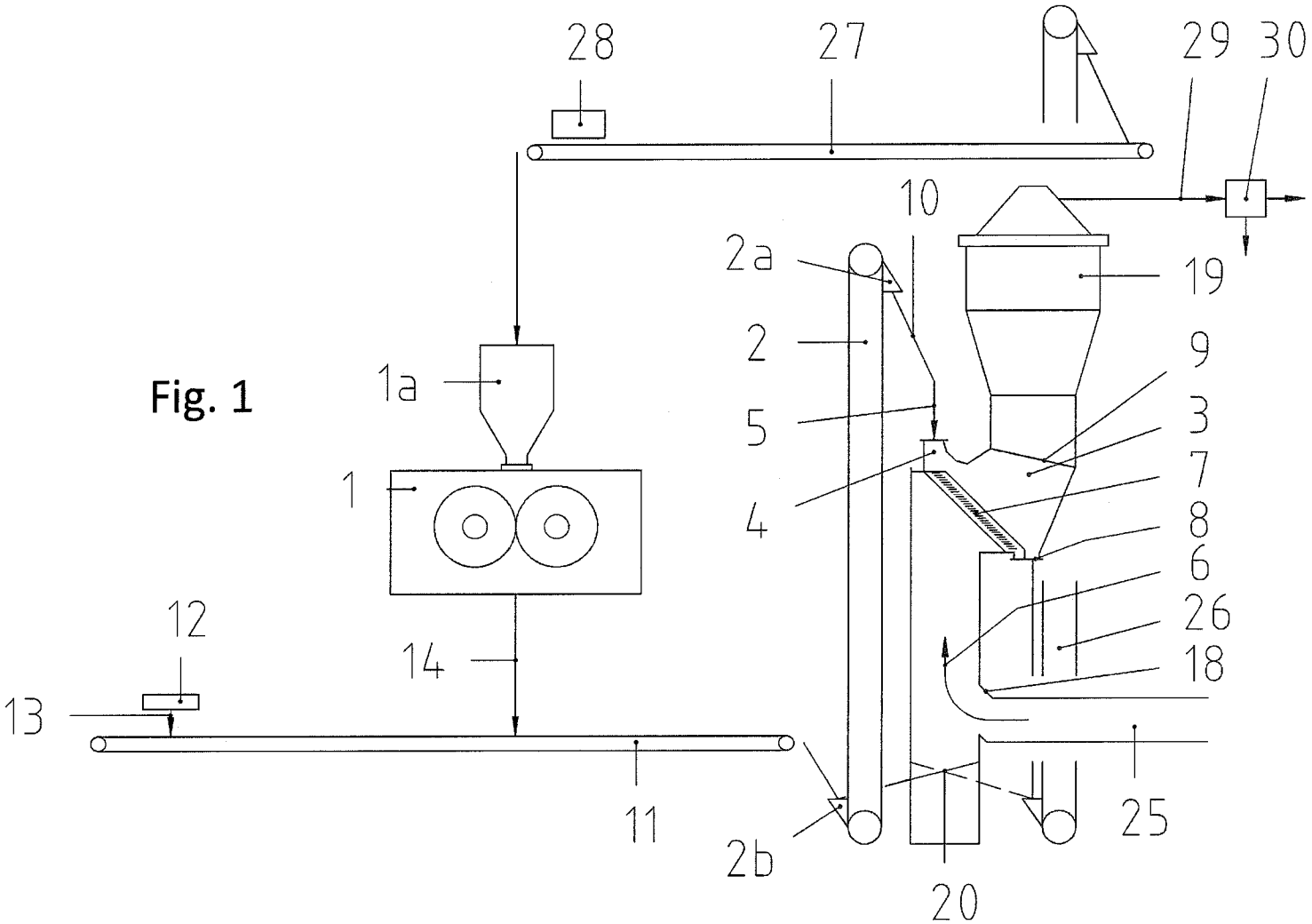
FIG. 1 is a schematic front view diagram of an embodiment of a grinding installation of the present disclosure.
Figure 2:
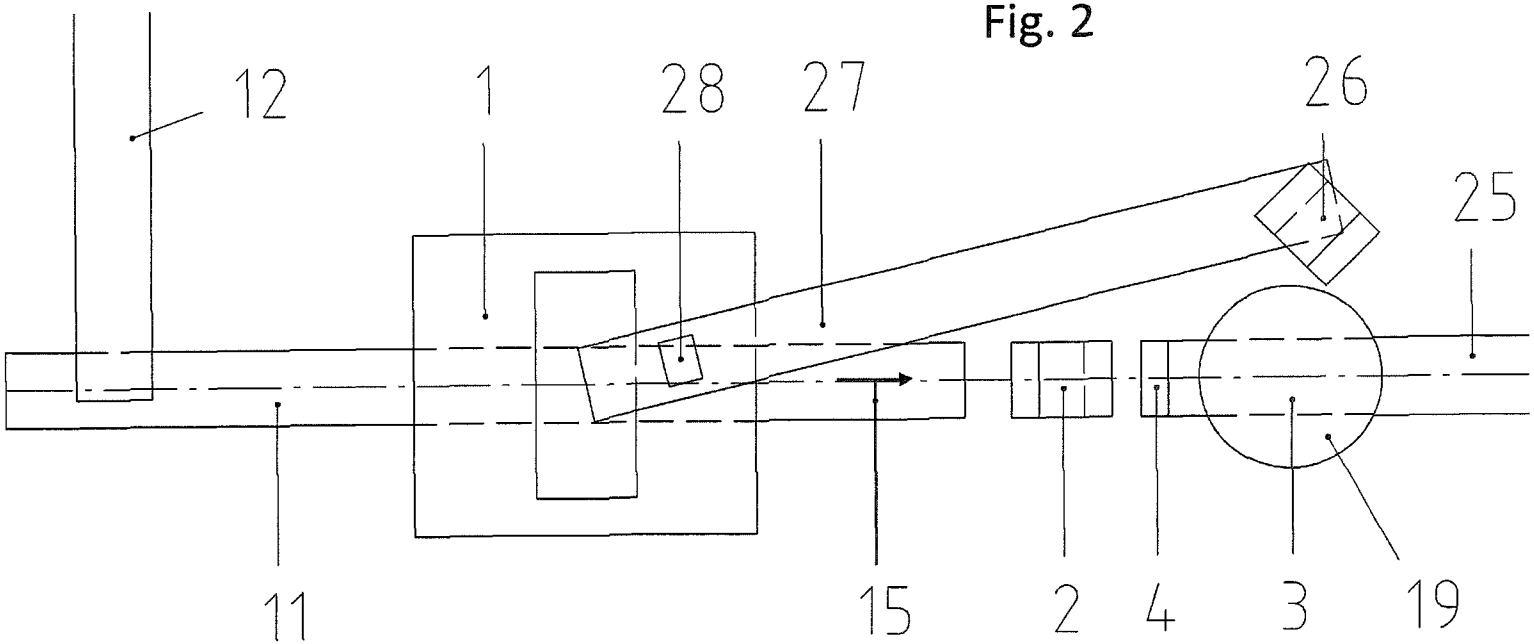
FIG. 2 is a schematic plan view of the grinding installation of FIG. 1.

The grinding installation shown in FIGS. 1 and 2 has, in essence, a roller press 1, a conveying mechanism 2 and a sifter 3. The roller press is equipped, for the purpose of comminuting brittle grinding stock such as limestone, with two counter-rotating grinding rollers which form between them a grinding gap and which are pressed against one another at high pressure. The roller press is in particular well suited to comminuting a bed of material, as is described in more detail in EP 0 084 383. The static sifter 3 has a sifting stock inlet 4 for fresh grinding stock 5 and/or grinding stock 5 comminuted in the roller press 1, an aeration plate 7 which is arranged at an angle to the horizontal and through which sifting gas 6 flows, an outlet 8 for oversized material and an outlet 9 for fine material. The conveying mechanism 2 is preferably formed as a bucket elevator, wherein its upper end 2*a* is connected to the sifting stock inlet 4 of the sifter 3 via a chute 10.

Furthermore, there is provided a conveying device 11, for example a conveyer belt or a belt conveyer, which is connected to a fresh material feed 12 and to the roller press 1 in order to transport fresh grinding stock 13 and/or grinding stock 14 comminuted in the roller press to the lower end 2*b* of the conveying mechanism 2.

As shown in FIGS. 1 and 2, the roller press 1, the conveying mechanism 2 and the sifter 3 are arranged one next to the other in terms of construction and in a straight line one behind the other in terms of the material flow direction 15. In order to achieve an optimal width distribution of the sifting stock when the latter is fed into the sifter 3, the width of the conveying mechanism 2 essentially corresponds to the width of the sifting stock inlet 4 of the sifter 3. In that context, the width of the conveying mechanism and of the sifter are for example at least 2.5 m, 3 m, 3.5 m or 4 m. The conveying mechanism can of course also be formed by two or more conveying mechanisms which are correspondingly narrower and are arranged immediately next to one another perpendicular to the conveying direction 15.

Figure 3:
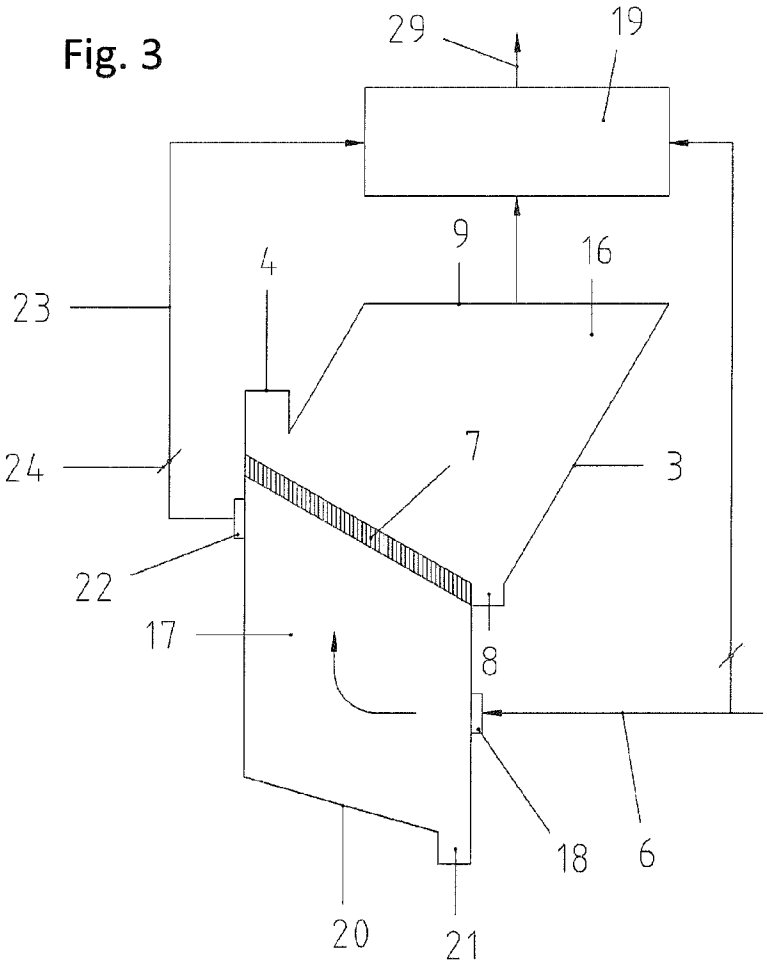
FIG. 3 is a schematic side view of an embodiment of a sifter of the present disclosure.

The sifter 3 will be described in more detail below with reference to FIG. 3. It consists, in essence, of an upper sifting space 16, a lower sifting space 17 and the aeration plate 7 which is arranged at an angle to the horizontal and separates the two sifting spaces from one another. The aeration plate 7 is formed as an inclined plane with aeration openings, or as an inclined perforated plate. The openings of the aeration plate can have different opening geometries distributed over the entire surface. That has the advantage that, by means of both the arrangement and also the respective opening geometry, it is possible to influence the distribution, the speed and the direction of the sifting gas in order to ensure that the sifting stock is flowed through optimally at every point of the aeration plate. It is thus possible to further raise the sifting efficiency.

The sifting stock inlet 4 opens into the upper sifting space 16 in the region of the upper end of the aeration plate 7 while, at the lower sifting space 17, there is provided a sifting gas inlet 18 for the supply of the sifting gas 6. The sifting gas flows from the sifting gas inlet 18 upward and through the aeration plate 7. The sifting gas thus flows in an essentially perpendicular manner through the sifting stock 5 in the upper sifting space 16, wherein the oversized material is ejected via the first outlet 8 for oversized material, arranged at the lower end of the aeration plate 7. The fine material is fed, together with the sifting gas, via the outlet 9 for fine material, to a downstream dynamic sifter 19. Thus, in the upper sifting space, there forms a transverse-flow sifting zone while in the lower sifting space there is provided a counter-flow sifting zone for the sifting stock falling through the aeration plate. The configuration of the dynamic sifter 19 and the interplay with the static sifter is for example known from EP 1 786 573 B1.

The oversized material of the counter-flow sifting zone falls down onto an inclined plate 20 of the lower sifting space 17, at the lower end of which there is provided a second outlet 21 for oversized material, for the oversized material of the counter-flow sifting zone. The angle of inclination of the inclined plate 20 is expediently greater than the wall friction angle of the oversized material to be ejected, so as to ensure that the oversized material slides out of the sifter on its own.

The fine material of the counter-flow sifting zone is either pressed with the sifting gas 6 through the aeration plate 7 or can in part be drawn off via a second outlet 22 for fine material, provided at the upper end of the lower sifting space 17, and fed via a line 23 to the dynamic sifter 19. The partial flow which is to be diverted from the lower sifting space 17 is established via a flap 24 arranged in the line 23, in order to thereby also be able to influence, in a targeted manner, the sifting conditions in the transverse sifting zone in the upper sifting space 16. A quantity of sifting gas drawn off via the line 23 accordingly reduces the quantity of sifting gas flowing through the aeration plate 7. It is thus possible to optimize the sifting gas speed distribution of the static sifter 3 for the dynamic sifter 19, without the associated aeration plate fall-through, i.e. the material which falls through the aeration plate, being able to negatively influence the entire process.

As is evident from FIGS. 1 and 2, the sifting stock inlet 4 is arranged on that side of the sifter oriented toward the conveying mechanism (2), while the sifting gas inlet 18 for the sifting gas 6 is connected to the sifter 3 in a region oriented away from the conveying mechanism, in this case on the opposite side. It is of course also possible, within the scope of the invention, that the sifting gas is supplied via two or more sifting gas inlets. In that context, a lateral supply can also in particular be considered. The angle between the orientation of the sifting stock inlet 4 and that of the sifting gas inlet 18 should be at least 15° and at most 345° in order that the conveying mechanism 2 can be arranged as close as possible to the sifter 3. The sifting gas inlet 18 with the connected sifting gas line 25 should thus not come into conflict with the conveying mechanism (2). It must in particular be ensured that the transport direction of the conveyed material runs in a straight line (as seen from above) as far as the sifter and thus also the connection between the conveying mechanism (2) and the sifting stock inlet 4 is arranged in a straight line in order to avoid any redirections of material, which necessarily result in a worsened width distribution on the aeration plate.

The two outlets 8 and 21 for oversized material permit an unrestricted return of the oversized material into the grinding and sifting process. By virtue of the second oversized material outlet 21 in the lower sifting space, the aeration plate fall-through no longer presents a problem. To that end, the oversized material carried off via the oversized material outlets 8 and 21 of the static sifter 3 is conveyed upward by a second conveying mechanism 26, wherein the upper end is connected via a further conveying device 27 to the feed shaft 1 a of the roller press 1. In turn, the second conveying mechanism 26 is expediently formed as a bucket elevator, wherein a belt conveyer can be considered for the further conveying device 27. In the region of the further conveying device 27, there is moreover provided a metal ejection device 28 by means of which any metal parts falling from the sifter can be removed before the roller press 1, in order to thus avoid damage to or destruction of the roller surfaces.

The fine material 29 from the dynamic sifter 19 is supplied, together with the sifting gas, to a separator 30.

The arrangement according to the invention of roller press, conveying mechanism and sifter permits a substantial reduction in the overall height. Moreover, all heavy loads are arranged close to the ground, which also permits easier access to the individual machines in the case of maintenance work. Moreover, the throughput can be increased by means of the use of wide sifters. Also, the low heights of the conveying mechanisms increase the mechanical reliability and thus permit higher turnover.

The invention claimed is:

1. A grinding installation, comprising:

a roller press having two counter-rotating grinding rollers and configured to comminute grinding stock;

a first conveying mechanism in operative communication with said roller press and configured to transport at least one of fresh grinding stock or the grinding stock comminuted by said roller press downstream; and a static sifter disposed downstream of and in operative communication with said first conveying mechanism and configured to sift the at least one of the fresh grinding stock or grinding stock comminuted by said roller press, said static sifter having, a sifting stock inlet disposed at a side of said sifter that is oriented toward said first conveying mechanism, said sifting stock inlet configured to accept at least one of fresh grinding stock or grinding stock comminuted by said roller press that has been conveyed to said sifter by said first conveying mechanism, a sifting gas inlet disposed at a side of said sifter that is oriented away from said first conveying mechanism, said sifting gas inlet configured to permit sifting gas to flow into said sifter, an aeration plate disposed within said sifter between each of said sifting stock inlet and said sifting gas inlet and at an angle to a horizontal plane, said aeration plate defining a first upper sifting space disposed above said aeration plate into which upper sifting space said sifting stock inlet opens and a second lower sifting space disposed below said aeration plate into which lower sifting space said sifting gas inlet opens, said aeration plate configured to permit sifting gas to flow from said sifting gas inlet in said second lower sifting space, through said aeration plate, and into said first upper sifting space so as to mix sifting gas with grinding stock conveyed through said sifting stock inlet into said first upper sifting space, a first oversized material outlet disposed in said first upper sifting space and in operative communication with said roller press, said first oversized material outlet configured to permit the removal of oversized material from said upper sifting space such that the oversized material can be conveyed back to said roller mill to be further comminuted, a second oversized material outlet disposed in said lower sifting space and configured to permit the removal of oversized material from said lower sifting space, and a fine material outlet disposed in said first upper sifting space.

2. The grinding installation of claim 1, wherein an angle between the orientation of the sifting stock inlet and that of the sifting gas inlet is at between 15° and 345°.

3. The grinding installation of claim 1, wherein said first conveying mechanism is a vertical conveying mechanism.

4. The grinding installation of claim 3, wherein said vertical first conveying mechanism is one of a bucket elevator or inclined belt elevator.

5. The grinding installation of claim 1, wherein said first conveying mechanism has a lower end and an upper end, wherein said upper end of said first conveying mechanism is in operative communication with said sifting stock inlet of said sifter by a chute disposed there between.

6. The grinding installation of claim 1, wherein said first conveying mechanism has a lower end and an upper end, wherein said upper end of said first conveying mechanism is in operative communication with said sifting stock inlet of said sifter, and wherein said lower end of said first conveying mechanism is in operative communication with each of said roller press and a fresh material feed.

7. The grinding installation of claim 6, further comprising a first conveying device, wherein said lower end of said first conveying mechanism is in operative communication with a first end of said first conveying device, and each of said roller press and said fresh material feed are in operative communication with a second opposing end of said first conveying device, said first conveying device configured to transport the grinding stock from said respective roller press or fresh material feed to said first conveying mechanism.

8. The grinding installation of claim 1, wherein said second lower sifting space includes an inclined bed, at a lower end of which inclined bed is disposed said second oversized material outlet.

9. The grinding installation of claim 1, further comprising a dynamic sifter coupled to said fine material outlet of said static sifter, said dynamic sifter configured to accept a mixture of fine material and sifting air received from said static sifter through said fine material outlet.

10. The grinding installation of claim 9, wherein said static sifter and said dynamic sifter are housed in a common sifter housing.

11. The grinding installation of claim 9, further comprising a separation device disposed downstream of, and in operative communication with, said dynamic sifter.

12. The grinding installation of claim 1, further comprising a second conveying mechanism in operative communication with each of said first and second oversized material outlets and said roller press, and configured to convey oversized material from said first and second oversized material outlets back to said roller mill to be further comminuted.

13. The grinding installation of claim 12, wherein said second conveying mechanism has a lower end in operative communication with said first and second oversized material outlets of said static sifter, and an upper end in operative communication with said roller press, by a second conveying device disposed there between.

14. The grinding installation of claim 13, further comprising a metal ejection device disposed along said second conveying device in a region of said second conveying device leading to said roller press.

15. The grinding installation of claim 1, wherein a width of said first conveying mechanism is substantially equal to a width of said sifting stock inlet of said static sifter.

* * * * *